United States Patent [19]

DeVaul et al.

[11] Patent Number: 4,702,029

[45] Date of Patent: Oct. 27, 1987

[54] COMBINATION SHOOTER'S BENCH AND GUN CARRYING CASE

[76] Inventors: Richard L. DeVaul, 7958 DeVaul Rd., Kirkville, N.Y. 13082; Gerald P. Vaikness, R.D. #1, Quarry Rd., Chittenango, N.Y. 13037

[21] Appl. No.: 924,311

[22] Filed: Oct. 29, 1986

[51] Int. Cl.[4] ..... F41C 29/00

[52] U.S. Cl. ..... 42/94

[58] Field of Search ..... 42/94; 89/37.04; 206/317; 211/64; 224/913

[56] References Cited

U.S. PATENT DOCUMENTS

| | | | |
|---|---|---|---|
| 2,121,982 | 6/1938 | Pugsley | 89/37.04 |
| 2,774,563 | 2/1956 | Pribis | 89/37.04 |
| 3,031,069 | 4/1962 | Hirsch | 206/16 |
| 3,711,984 | 1/1973 | Dyer et al. | 42/94 |
| 3,964,613 | 6/1976 | Anderson, Jr. | 211/64 |
| 4,301,898 | 11/1981 | Plough et al. | 190/52 |
| 4,501,082 | 2/1985 | Phillips et al. | 42/94 |
| 4,506,466 | 3/1985 | Hall | 42/94 |
| 4,535,559 | 8/1985 | Hall | 42/94 |
| 4,545,144 | 10/1985 | Schuster | 42/94 |
| 4,563,829 | 1/1986 | Bozick | 42/94 |
| 4,565,403 | 1/1986 | Brown | 297/3 |

OTHER PUBLICATIONS

Cabela's 1986 Spring Catalog, p. 91; Spring 1986.

*Primary Examiner*—Charles T. Jordan
*Attorney, Agent, or Firm*—Bruns and Wall

[57] ABSTRACT

A gun case for a target rifle also serves as a collapsible portable shooter's bench. The bench has three detachable legs and three sockets or mounts on each side, permitting the shooter's bench to be set up for the right handed or left handed shooters. A gun rest for supporting the rifle fits into a socket or sleeve in the case. The case is equipped with locks to secure it when being stored or transported.

10 Claims, 4 Drawing Figures

COMBINATION SHOOTER'S BENCH AND GUN CARRYING CASE

BACKGROUND OF THE INVENTION

This invention relates to collapsible, portible shooter's benches or tables, and is more particularly directed to a carrying case for a target rifle which can double as a shooter's bench.

Shooter's benches or tables are commonly found at target ranges. These are employed for holding or steadying a target rifle, because the accuracy and range of modern rifles and affiliated sighting equipment is such that optimum marksmanship is possible only if the rifle is held absolutely steady. This degree of steadiness is impossible if the shooter supports the rifle himself or herself.

In addition to fixed-location shooting benches, various portable gun rests, such as monopod, bipod, and tripod rests have been introduced, as have several portable shooting benches. A tripod type shooting bench, having a gun rest of adjustable height and a collapsible portable stool for the shooter, is described in Hall U.S. Pat. No. 4,535,559. This bench is a rather small affair, and although highly portable, does not afford the shooter a good surface on which to rest his or her elbows when shooting. Another portable shooter's bench is described in U.S. Pat. No. 4,506,466, which includes a table-type gun rest with an associated seat, both of which are supported on collapsible or folding legs. This device is intended for right handed shooters, and is not easily reversed for use by left handed shooters.

A shooter's bench and table assembly, which incorporates a chest for storing a rifle, is described in U.S. Pat. No. 4,565,403. This assembly is a rather massive affair, with a table surface and legs which nest together on top of or beneath the chest. Also, the table is of a shape that does not provide an optimum shooting position, whether for right or left handed shooters.

Of course, it is desirable both for target shooting and for sport shooting to be able to carry and set up the rifle and the shooter's bench under a variety of field conditions, many of which may involve quite uneven terrain. It is also desirable for sport shooting, i.e., hunting, at extreme range, to set up the rifle on a shooting bench. However, the amount of equipment for such sport shooting should of necessity be kept to an absolute minimum. For that reason, the bench should be as light-weight and compact as possible, and should be serviceable under any of a variety of field conditions. Also, the shooter or hunter should be able to transport both the rifle and the shooter's bench without encumbering himself or herself with a large number of separate pieces of equipment.

OBJECTS AND SUMMARY OF THE INVENTION

Accordingly, it is an object of this invention to provide a shooter's bench which is useful in field conditions, and is also light-weight and portable.

It is a more specific object of this invention to provide a gun case for secure storage and protection of fine, high quality target rifles, and which gun case can double as a field-type shooter's bench.

It is another object of this invention to provide a combination gun case and shooter's bench which can be set up for either right handed or left handed shooters.

It is an object of this invention to provide a combination gun case and field shooter's bench in which all of the required shooting equipment can be carried as a single package.

It is a further object of this invention to provide a combination gun case and field shooter's bench in which a stool or a chair can be stored, as well as the target rifle and other equipment.

According to an aspect of this invention, the combination gun case and shooter's bench is provided as a light-weight carrying case suitably dimensioned for storing and carrying a target rifle, and which can be converted for use as a shooter's bench by attaching three light-weight collapsible legs and an adjustable gun rest. The legs and the gun rest are stored inside the case with the rifle. An aluminum folding chair or stool is also stored inside the case, and provides a seat for the shooter.

The case is formed of two generally L-shaped casing halves, each of which has a flat horizontal L-shaped panel and a surrounding side wall or skirt. The side walls are hinged together with a full-length piano hinge so that the casing halves close together in a clamshell fashion. Each of the flat horizontal panels includes three leg mountings and a gun rest sleeve or socket. The three adjustable-length legs, which each include means for detachably mounting the legs to respective ones of the casing leg mountings, are attached onto one of the L-shaped horizontal panels, which becomes the lower panel. The gun rest, which is formed of a yoke for supporting the target rifle and a post supporting the yoke. The post is inserted into the gun rest sleeve on the upper casing half. The L-shaped case has a relatively wide end at its front and a relatively narrow end rearward, and beside the relatively narrow end a cutout forms a shooter's position. The legs and the gun rest are attached to the appropriate ones of the leg mounts and gun rest sleeve so that the cutout is on the left side for a right handed shooter or on the right side for a left handed shooter.

The casing can be injection molded from a suitably strong plastic resin, such as high density polyethylene, and the casing can be lined with soft, thick convoluted foam padding. The adjustable legs, the adjustable gun rest, and the folding chair are preferably formed of a strong light-weight material, such as an aluminum or magnesium alloy. The case is also provided with locking draw bolts for securing the case for storage or transport.

The above and many other objects, features and advantages of this invention will be more fully understood from the ensuing detailed description of a preferred embodiment, which should be considered in connection with the accompanying drawing.

DETAILED DESCRIPTION OF THE PREFERRED EMBODIMENT

Figure 1:
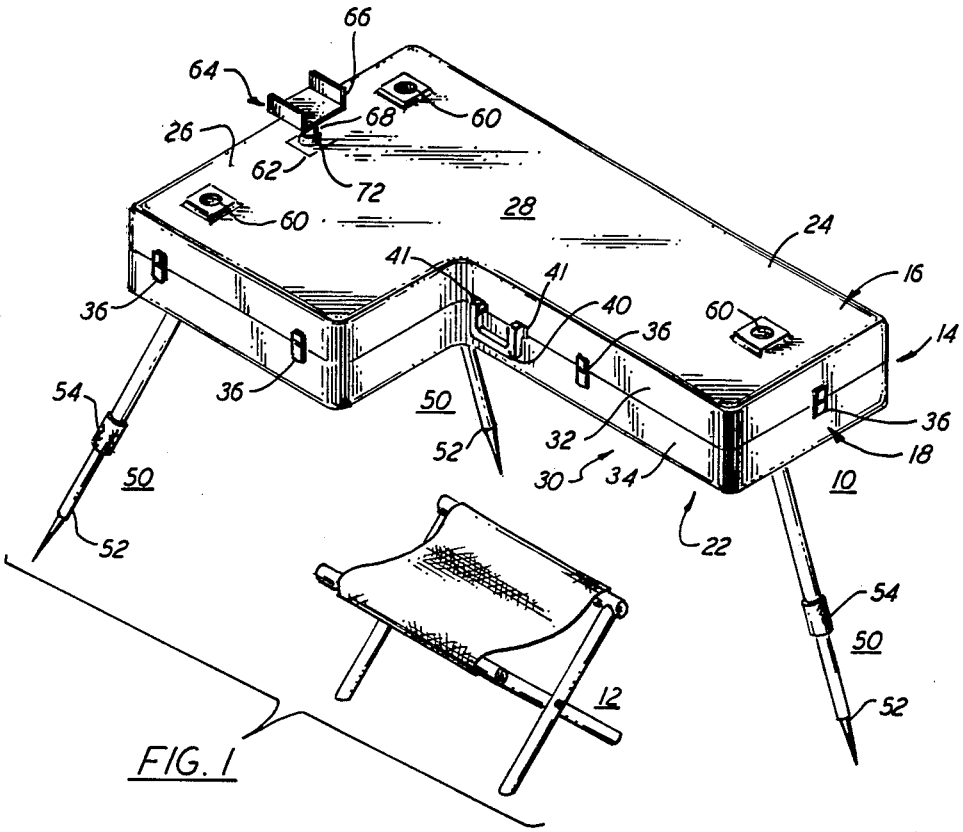
FIG. 1 is a perspective view of the combination rifle case and shooter's bench according to a preferred embodiment of this invention.
Figure 2:
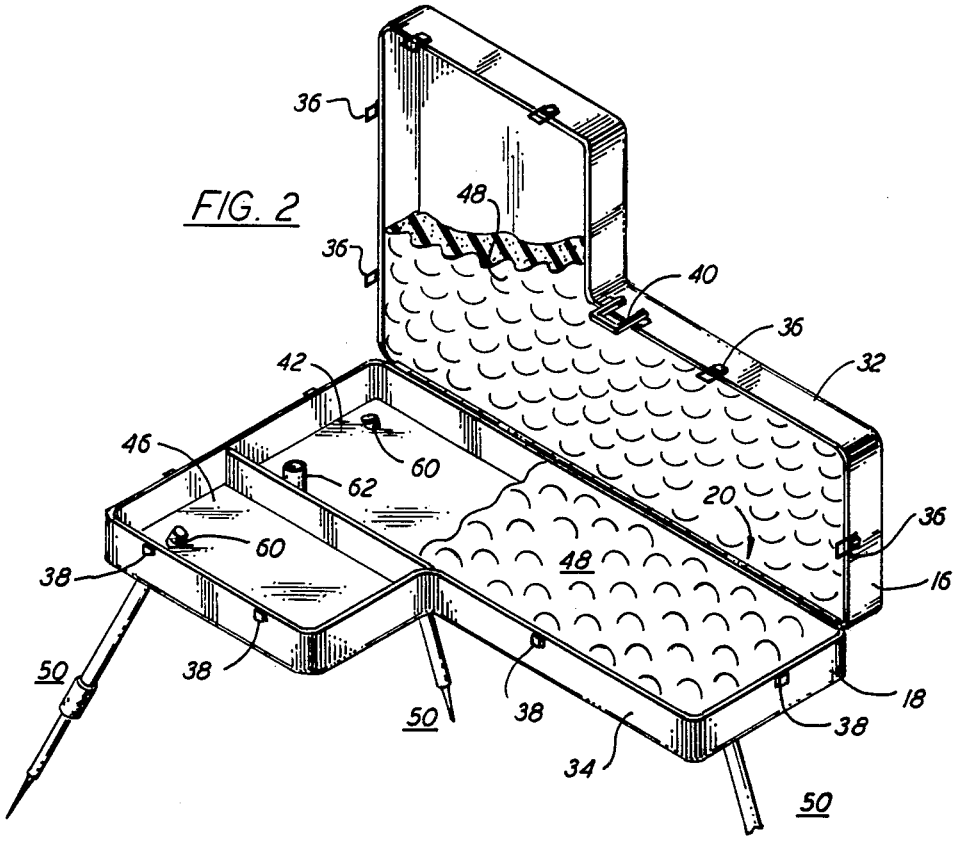
FIG. 2 is a perspective view, with some parts cut away, of the combination case and bench, with the case being open.

With reference to the drawing, and initially to FIG. 1 thereof, a combination shooter's bench and gun case 10 is shown with an appropriately positioned folding chair or stool 12. The combination bench and case 10 has an outer casing 14, formed of an L-shaped upper half 16 and an L-shaped lower half 18. These are joined along a long edge thereof a full-length piano hinge 20 (See FIG. 2) so that the casing opens and closes in clamshell fashion. The casing 14, when closed, serves as the bench or table top and has a cutout 22 defining the shooter's position. It is at the position of this cutout 22 that the folding chair 12 is placed. A relatively narrow rear portion 24 of the case 14 is disposed alongside the cutout 22, and a relatively broad portion 26 is disposed forward of the cutout 22 and rear portion 24. Each of the upper half 16 and lower half 18 has a respective L-shaped horizontal panel 28,30 these panels 28,30 being mirror images of one another. In this embodiment, the panels have dimensions of fifty-two inches on their long side, thirty-two inches across the front portion 26, and sixteen inches across the rear portion 24. The cutout 22 is then sixteen inches by twenty-six inches, and the broad front portion 26 is twenty-six inches in length. Each of the casing halves 16 and 18 has a skirt or edge 32,34 that is four inches across, giving the casing 14 an overall depth of eight inches. Clasp mechanisms are provided with latches 36 on the upper casing half 16 and corresponding catches 38 on the lower casing half 18. A carrying handle 40 is provided with dual locking bolts 41 and is positioned on the edge 32 within the cutout 22.

Figure 3:
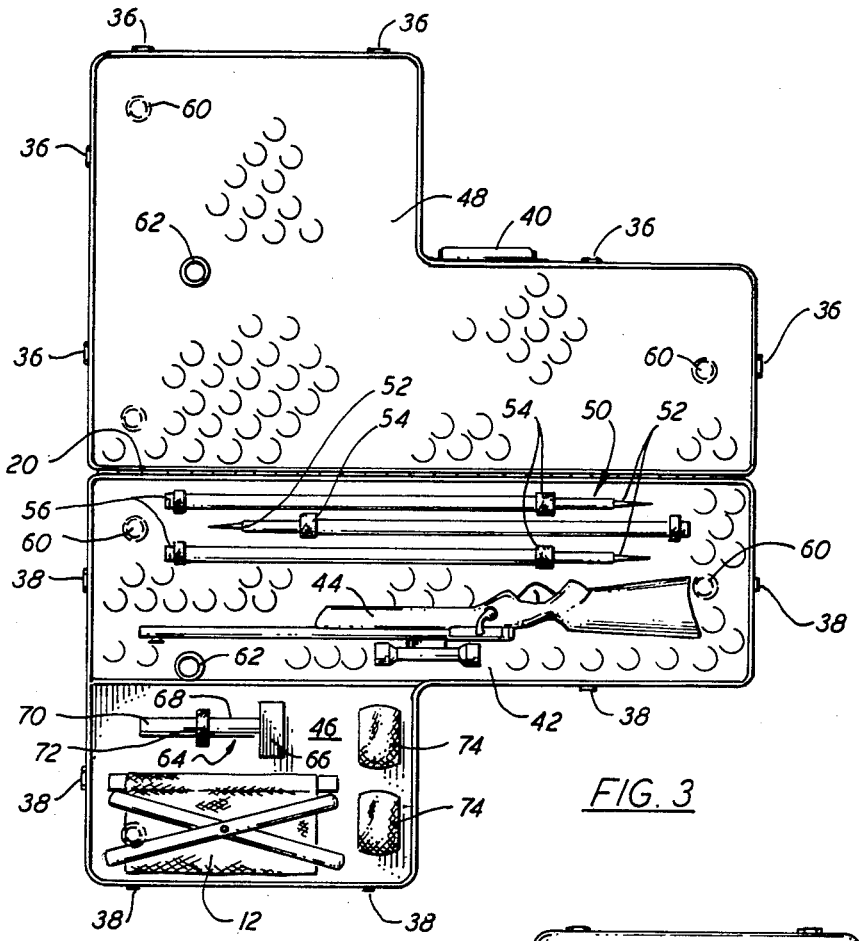
FIG. 3 is a top plan view of this embodiment, with the case being opened flat.

As is shown in FIG. 3, the interior of the casing 14 is divided into a relatively long compartment 42 for storing and carrying a target rifle 44, and a relatively small compartment 46 formed in the toe of the L-shaped case 14, for storage of other equipment. Here the compartment 42 is filled with high quality polyurethane convoluted foam lining 48, and the interior of the entire upper half 16 is filled with the resilient foam lining 48. Three collapsible, adjustable-length, detachable legs 50 are provided, and these are stored in the long compartment 42 together with the rifle 44. These are attached in tripod fashion to support the case as shown generally in FIGS. 1 and 2.

The legs 50 each have a foot 52, a locking ring 54 for locking the leg length when adjusted properly, and a mounting fitting 56 at the upper end of the leg 50.

Three leg mounts 60 are formed on each of the panels 28 and 30, one of these mounts 60 being at the rear portion 24 and the other two being at the relatively broad forward portion 26. A tubular gun-rest socket or sleeve 62 is located in the relatively broad portion of each casing half panel 28,30, here positioned about midway between the two front leg mounts 60. Each sleeve 62 protrudes into the case about four inches (See FIG. 2).

A gun rest 64, shown as positioned in the sleeve 62 in FIG. 1 and as stored for transport in FIG. 3, has a generally U-shaped yoke 66 on which the rifle 44 is rested for shooting, and a post supporting the yoke 66. The post is formed of an upper post portion 68 and a lower post portion 70, with an adjusting ring 72 permitting adjustment of the total length of the post portions 70 and 68. The lower post portion 70 fits into the sleeve 62 and permits rotation of the gun rest 64 for selecting the proper angle of shooting.

The folding chair 12 can be completely collapsed, as shown in FIG. 3, and stored within the smaller compartment 46, together with the gun rest 64 and one or more sandbags 74. The latter, which are optional, are sometimes used for adjusting the position of the shooter's elbows on the top of the shooting bench. Ammunition is carried separately from the rifle 44 for safety reasons, and thus is not shown here.

Figure 4:
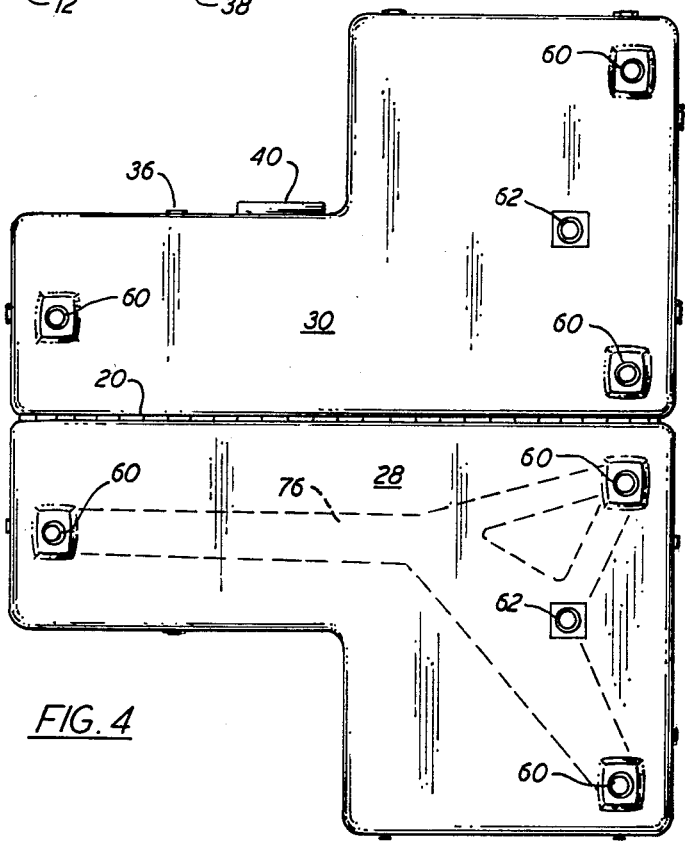
FIG. 4 is a bottom plan view of this embodiment, with the case being opened flat.

As shown in ghost lines in FIG. 4, reinforcing struts 76, which can either be separate members or ribs that are integrally formed with the panels 28 and 30, provide added structural stability to the leg mounts 60. This feature can be included where required to render the panels 28,30 sufficiently rigid to support the rifle 44 for accurate shooting.

For transport to a shooting location, the rifle 44, the legs 50, the gun mount 64, the chair 12, and any other equipment are positioned generally as shown in FIG. 3. When the shooter arrives at the shooting location, the combination bench and case 10 is set up by removing the contents and attaching the mounting fittings 56 of the legs 50 to the leg mounts 60 on the appropriate one of the casing halves 14 and 16. For a right hand shooter, the legs would be attached as shown in FIG. 1. The legs 50 are then adjusted for proper length to achieve correct shooting comfort for the shooter and also to attain a secure footing on the particular terrain at that location. Then, the gun rest 64 is inserted into the upper sleeve 62. The height of the gun rest 64 is adjusted. Then the shooter can be seated on the folding chair 12 and rest his or her rifle 44 on the gun rest 64 and prepare for shooting.

The shooting bench of this invention is quickly and easily set up and can be used for any of a variety of shooters, being adjustable both as to height and to preference for left handed or right handed shooting. The gun and all other shooting equipment can be readily stored and carried.

While the invention has been described in detail with respect to a preferred embodiment, it should be understood that the invention is not limited to that embodiment, but that many modifications and variations thereof would present themselves to those of skill in the art without departing from the scope and spirit of this invention, as defined in the appended claims.

What is claimed is:

1. A combination gun case and shooter's bench comprising a casing having first and second casing halves suitably dimensioned to contain a target rifle, each said casing half being formed of a flat horizontal panel and a side wall, the side walls being hinged to close together in clamshell fashion, each of said flat horizontal panels including a plurality of leg mountings formed on an outer surface thereof and a gun rest sleeve thereon extending normal thereto;

a plurality of adjustable-length legs including means for detachably mounting the legs to respective leg mountings on either of said flat horizontal panels; and a gun rest having a yoke for supporting said target rifle for shooting and a post supporting said yoke, the post being insertable into the gun rest sleeve on either of said casing halves.

2. The combination gun case and shooter's bench of claim 1 in which said casing halves are L-shaped, with the flat horizontal panels each having a relatively wide end in which two of said leg mounts and the associated gun rest sleeve are disposed, and a relatively narrow end in which one of said leg mounts is disposed.

3. The combination gun case and shooter's bench of claim 1 in which said legs are collapsible to a minimum length such that the legs when detached can be stored inside the casing.

4. The combination gun case and shooter's bench of claim 1 said casing comprising a first compartment for carrying said target rifle and said legs, and a second compartment; and further comprising a folding chair which can be collapsed and stored in said second compartment.

5. The combination gun case and shooter's bench of claim 1 wherein said gun rest post includes means for adjusting the height of said yoke above the casing.

6. A combination gun case and shooter's bench comprising a generally L-shaped casing having first and second casing halves suitably dimensioned to contain a target rifle and serving as a portable bench, the casing halves each having a flat horizontal L-shaped panel with a cutout defining a shooter's position, a relatively narrow portion alongside said shooter's position, and a relatively wide portion forward of the shooter's position and the narrow portion; the casing including a plurality of leg mounts on the L-shaped panel of said first casing half and a gun rest sleeve in the relatively wide portion of the L-shaped panel of the second casing half;

a plurality of legs which include means for detachably mounting the legs to respective ones of said leg mounts; and a gun rest having a yoke for supporting said target rifle for shooting and a post supporting said yoke, the post being insertable into said gun rest sleeve.

7. A combination gun case and shooter's bench as in claim 6, further comprising an additional plurality of said leg mounts on the L-shaped panel of said second casing half and an additional gun test sleeve in the relatively wide portion of the L-shaped panel of said first casing half, such that said legs can be mounted to support said casing with the cutout thereof on the appropriate side for either a right handed or a left handed shooter.

8. A combination gun case and shooter's bench as in claim 6, wherein said casing has a first compartment therein in which said target rifle and said legs can be stored for transport, and a second compartment therein for storing a folding stool.

9. A combination gun case and shooter's bench as in claim 6 in which each of said legs includes means for adjusting the length thereof.

10. A combination gun case and shooter's bench as in claim 6 further comprising reinforcing means within said casing for rendering said L-shaped panels rigid enough to support said target rifle for accurate shooting.

* * * * *

UNITED STATES PATENT AND TRADEMARK OFFICE

CERTIFICATE OF CORRECTION

PATENT NO. : 4,702,029

DATED : October 27, 1987

INVENTOR(S) : RICHARD L. DeVAUL et al.

It is certified that error appears in the above-identified patent and that said Letters Patent is hereby corrected as shown below:

Claim 7, line 10 - "test" should read "rest".

Signed and Sealed this

Fifteenth Day of March, 1988

*Attest:*

*Attesting Officer*

DONALD J. QUIGG

*Commissioner of Patents and Trademarks*